US011008659B2

(12) United States Patent
Saito et al.

(10) Patent No.: US 11,008,659 B2
(45) Date of Patent: May 18, 2021

(54) TRIVALENT CHROMIUM CHEMICAL CONVERSION LIQUID FOR ZINC OR ZINC ALLOY BASES AND CHEMICAL CONVERSION COATING FILM

(71) Applicant: Dipsol Chemicals Co., Ltd., Tokyo (JP)

(72) Inventors: Ayumi Saito, Edogawa-ku (JP); Masatoshi Ishikawa, Nagoya (JP); Takashi Koike, Ageo (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 452 days.

(21) Appl. No.: 15/539,566

(22) PCT Filed: Dec. 25, 2015

(86) PCT No.: PCT/JP2015/086229

§ 371 (c)(1),
(2) Date: Jun. 23, 2017

(87) PCT Pub. No.: WO2016/104703

PCT Pub. Date: Jun. 30, 2016

(65) Prior Publication Data

US 2019/0136383 A1 May 9, 2019

(30) Foreign Application Priority Data

Dec. 26, 2014 (JP) ..... JP2014-266254

(51) Int. Cl.

| | |
|---|---|
| ***C23C 22/34*** | (2006.01) |
| ***C23C 22/46*** | (2006.01) |
| ***C23C 22/53*** | (2006.01) |
| ***C23C 22/78*** | (2006.01) |

(52) U.S. Cl.

CPC ..... *C23C 22/34* (2013.01); *C23C 22/46* (2013.01); *C23C 22/53* (2013.01); *C23C 22/78* (2013.01); *C23C 2222/10* (2013.01)

(58) Field of Classification Search

CPC ..... C23C 22/34; C23C 22/46; C23C 22/53; C23C 22/78

USPC ..... 148/247

See application file for complete search history.

(56) References Cited

U.S. PATENT DOCUMENTS

| | | | |
|---|---|---|---|
| 6,375,726 | B1 | 4/2002 | Matzdorf et al. |
| 2002/0053301 | A1 | 5/2002 | Matzdorf et al. |
| 2006/0180247 | A1 | 8/2006 | Matzdorf et al. |
| 2006/0240191 | A1 | 10/2006 | Matzdorf et al. |
| 2012/0145282 | A1 | 6/2012 | Kodama et al. |

FOREIGN PATENT DOCUMENTS

| | | | | |
|---|---|---|---|---|
| CN | 101184867 | A | | 5/2008 |
| CN | 101189073 | A | | 5/2008 |
| JP | 2006-316334 | A | | 11/2006 |
| JP | 2006-328501 | A | | 12/2006 |
| JP | 2010-150626 | | * | 7/2010 |
| JP | 2010-150626 | A | | 7/2010 |
| JP | 2012-036469 | | * | 2/2012 |
| JP | 2012-036469 | A | | 2/2012 |
| KR | 10-2008-0017318 | | | 2/2008 |
| WO | WO-2011/002040 | A1 | | 1/2011 |

OTHER PUBLICATIONS

Chinese Office Action, dated Jun. 27, 2018, issued in corresponding Chinese Patent Application No. 201580070255.8.

Partial Supplementary European Search Report, dated Jul. 9, 2018, issued in corresponding European Patent Application No. 15873271.9.

International Search Report and Written Opinion for PCT/JP2015/086229 dated Mar. 15, 2016.

Japanese Office Action, issued in Japanese Patent Application No. 2016-566511, 7 pages (dated Feb. 25, 2019).

Second Office Action, dated May 30, 2018, issued in corresponding Korean Patent Application No. 10-2017-7017005.

Office Action for Korean Appl. Ser. No. 10-2017-7017005 dated Mar. 13, 2018 (10 pages).

Chinese Third Office Action, issued in Chinese Patent Appln. No. 201580070255.8, 8 pages (dated Apr. 26, 2019).

* cited by examiner

*Primary Examiner* — Melissa S Swain
(74) *Attorney, Agent, or Firm* — Foley & Lardner LLP

(57) ABSTRACT

The present invention provides a chemical conversion liquid for zinc or zinc alloy bases, which contains 2-200 mmol/L of trivalent chromium ions, 1-300 mmol/L of zirconium ions and at least one component selected from among fluorine ions, a water-soluble carboxylic acid and a salt thereof, and which does not contain Co ions and hexavalent chromium ions.

12 Claims, No Drawings

TRIVALENT CHROMIUM CHEMICAL CONVERSION LIQUID FOR ZINC OR ZINC ALLOY BASES AND CHEMICAL CONVERSION COATING FILM

This application is a U.S. National Stage of International Application No. PCT/JP2015/086229, filed on Dec. 25, 2015, designating the United States, and claiming the benefit of Japanese Patent Application No. 2014-266254, filed with the Japanese Patent Office on Dec. 26, 2014, all of which are hereby incorporated by reference in their entireties.

TECHNICAL FIELD

The present invention relates to a novel chemical conversion treatment solution for imparting an excellent corrosion resistance to a zinc- or zinc alloy-metal surface, and a chemical conversion coating obtained from the solution.

BACKGROUND ART

A chemical conversion treatment is a technique having been utilized from the past to impart a corrosion resistance to metal surfaces. At present also, this technique is used in the surface treatments for aircrafts, construction materials, automotive parts, and so forth. Meanwhile, a coating obtained by a chemical conversion treatment represented by chromic acid/chromate chemical conversion treatment partially contains harmful hexavalent chromium.

Hexavalent chromium is restricted by the WEEE (Waste Electrical and Electronic Equipment) Directive, the RoHS (Restriction of Hazardous Substances) Directive, the ELV (End of Life Vehicles) Directive, and so forth. Chemical conversion treatment solutions using trivalent chromium instead of hexavalent chromium are actively studied for the industrialization.

Nevertheless, a trivalent chromium chemical conversion treatment solution for a zinc or zinc alloy substrate is generally supplemented with a cobalt compound to enhance the corrosion resistance.

Cobalt is one of what is called a rare metal. It cannot necessarily be said that the cobalt supply system stable because the usage and application of cobalt are increasing or the countries where cobalt is produced are limited, for example. Moreover, cobalt chloride, cobalt sulfate, cobalt nitrate, and cobalt carbonate are listed as SVHCs (Substances of Very High Concern) in REACH (Registration, Evaluation, Authorization and Restriction of Chemicals) regulation. The uses of these compounds are likely to be restricted.

Meanwhile, as environmentally-friendly chemical conversion treatment solutions for a zinc or zinc alloy substrate, several chromium-free chemical conversion treatment solutions have been reported. For example, there have been known: a treatment agent containing a compound selected from zirconium and titanium, a compound selected from vanadium, molybdenum, and tungsten, and further an inorganic phosphorus compound (Japanese Patent Application Publication No. 2010-150626); and a fluorine- and chromium-free chemical conversion treatment agent containing a compound selected from water-soluble titanium compounds and water-soluble zirconium compounds, and an organic compound having functional groups (International Publication No. WO2011/002040).

However, such chromium-free chemical conversion treatment agents are inferior to conventional cobalt-containing chemical conversion treatment agents for zinc or zinc alloys in chemical conversion treatment coating performances such as corrosion resistance. An improvement in this respect has been desired.

SUMMARY OF INVENTION

In view of the circumstances as described above, an object of the present invention is to provide a chemical conversion treatment solution for a zinc or zinc alloy substrate, the solution containing substantially no cobalt compound and being excellent in corrosion resistance and capable of forming a chemical conversion coating while taking the environment also into consideration.

The present inventors have intensively studied a chemical conversion treatment solution which is excellent in corrosion resistance without incorporating hexavalent chromium ions and cobalt ions, and which is capable of forming a chemical conversion coating while taking the environment also into consideration. As a result, the inventors have found out that the above object is achieved by a chemical conversion treatment solution containing both zirconium ions and trivalent chromium ions, and further containing at least one of fluorine ions and water-soluble carboxylic acids or salts thereof. This finding has led to the completion of the present invention.

Specifically, the present invention provides a chemical conversion treatment solution for a zinc or zinc alloy substrate, the solution comprising:

2 to 200 mmol/L of trivalent chromium ions;

1 to 300 mmol/L of zirconium ions; and at least one of fluorine ions and water-soluble carboxylic acids or salts thereof, wherein the solution does not comprise Co ions and hexavalent chromium ions.

Moreover, the present invention provides a chemical conversion treatment method for a zinc or zinc alloy substrate, the method comprising bringing the chemical conversion treatment solution into contact with a zinc or zinc alloy substrate.

Further, the present invention provides a chemical conversion treatment coating formed from the chemical conversion treatment solution, the coating comprising trivalent chromium and zirconium but not comprising hexavalent chromium and cobalt.

The present invention makes it possible to provide a chemical conversion treatment solution for a zinc or zinc alloy substrate, the solution not containing hexavalent chromium and cobalt but being excellent in corrosion resistance and capable of forming a chemical conversion coating while taking the environment also into consideration.

DESCRIPTION OF EMBODIMENTS

A substrate used in the present invention includes substrates of metals and alloys such as various metals including iron, nickel, and copper, alloys thereof, and aluminum subjected to a zincate conversion treatment, which are in various shapes such as plate, cuboid, solid cylinder, hollow cylinder, or sphere.

The substrate is plated with zinc and a zinc alloy in a usual manner. To deposit zinc plating on the substrate, it is possible to use any one of acidic or neutral baths such as a sulfuric acid bath, a fluoborate bath, a potassium chloride bath, a sodium chloride bath, and an ammonium chloride eclectic bath; and alkaline baths such as a cyanide bath, a zincate bath, and a pyrophosphate bath. Especially, a zincate bath is preferable. Moreover, the zinc alloy plating may be conducted by using any alkaline bath such as an ammonium chloride bath or an organic chelate bath.

In addition, the zinc alloy plating includes zinc-iron alloy plating, zinc-nickel alloy plating, zinc-cobalt alloy plating, tin-zinc alloy plating, and the like. Zinc-iron alloy plating is preferable. The zinc or zinc alloy plating may be deposited on the substrate to any thickness, but the thickness should be 1 μm or more, preferably 5 to 25 μm.

In the present invention, after the zinc or zinc alloy plating is deposited on the substrate as described above, the resultant is optionally subjected as appropriate to a pretreatment, for example, washing with water, or washing with water and then activation treatment with nitric acid. Then, a chemical conversion treatment is conducted by a method, for example, such as an immersion treatment, using a chemical conversion treatment solution for a zinc or zinc alloy substrate of the present invention.

The chemical conversion treatment solution for a zinc or zinc alloy substrate of the present invention contains 2 to 200 mmol/L of trivalent chromium ions, 1 to 300 mmol/L of zirconium ions, and at least one of fluorine ions and water-soluble carboxylic acids or salts thereof, but does not contain Co ions and hexavalent chromium ions.

The type of a trivalent chromium compound for providing the trivalent chromium ions is not particularly limited, but the trivalent chromium compound is preferably water soluble.

Examples of the trivalent chromium compound include $Cr(NO_3)_3.9H_2O$, $Cr(CH_3COO)_3$, $Cr_2(SO_4)_3.18H_2O$, $CrK(SO_4)_2.12H_2O$, and the like. These trivalent chromium compounds may be used alone, or two or more thereof may be used in combination. The content of the trivalent chromium ions is 2 to 200 mmol/L, preferably 5 to 100 mmol/L, and more preferably 10 to 80 mmol/L. When the content of the trivalent chromium ions is within such ranges, an excellent corrosion resistance can be obtained.

The type of a zirconium compound for providing the zirconium ions is not particularly limited, but the zirconium compound is preferably water soluble. Examples of the zirconium compound include: inorganic zirconium compounds or salts thereof such as zirconium nitrate, zirconium oxynitrate, ammonium zirconium nitrate, zirconyl chloride, zirconyl sulfate, zirconium carbonate, ammonium zirconyl carbonate, potassium zirconyl carbonate, sodium zirconyl carbonate, and lithium zirconyl carbonate; and organic zirconium compounds such as zirconyl acetate, zirconium lactate, zirconium tartrate, zirconium malate, and zirconium citrate. Preferable zirconium compounds include zirconium hydrofluoric acid ($H_2ZrF_6$) and salts thereof, for example, a sodium salt, a potassium salt, a lithium salt, and an ammonium salt [$(NH_4)_2ZrF_6$] of zirconium hydrofluoric acid ($H_2ZrF_6$); and the like. These zirconium compounds may be used alone, or two or more thereof may be used in combination. The content of the zirconium ions is 1 to 300 mmol/L, preferably 5 to 150 mmol/L, and more preferably 10 to 100 mmol/L. When the content of the zirconium ions is within such ranges, an excellent corrosion resistance can be obtained.

A molar ratio between the trivalent chromium ions and the zirconium ions (trivalent chromium ions/zirconium ions) is preferably 2.5 or less, more preferably 0.1 to 2.5, furthermore preferably 0.2 to 2.1, and most preferably 0.3 to 2.0. When the molar ratio between the trivalent chromium ions and the zirconium ions is within such ranges, an excellent corrosion resistance can be obtained.

The chemical conversion treatment solution for a zinc or zinc alloy substrate of the present invention further contains at least one of fluorine ions and water-soluble carboxylic acids or salts thereof.

The type of a fluorine-containing compound for providing the fluorine ions is not particularly limited. Examples of the fluorine-containing compound include hydrofluoric acid, borohydrofluoric acid, ammonium fluoride, hexafluorozirconic acid, salts thereof, and the like. Hexafluorozirconic acid is preferable. These fluorine-containing compounds may be used alone, or two or more thereof may be used in combination. The content of the fluorine ions is preferably 5 to 500 mmol/L, and more preferably 60 to 300 mmol/L. The fluorine ions serve as counterions of the zirconium ions. When the content of the fluorine ions is within such ranges, the zirconium ions can be stabilized.

The type of the water-soluble carboxylic acids is not particularly limited. Examples of the water-soluble carboxylic acids include dicarboxylic acids which can be represented by $R_1$—$(COOH)_2$ [$R_1$=$C_0$ to $C_8$] such as oxalic acid, malonic acid, succinic acid, glutaric acid, adipic acid, and suberic acid. Preferable are oxalic acid and malonic acid, where $R_1$=$C_0$ and $C_1$, respectively. Examples of the salts of the water-soluble carboxylic acids include salts of alkali metals such as potassium and sodium, salts of alkaline earth metals such as calcium and magnesium, ammonium salts, and the like. These water-soluble carboxylic acids or salts may be used alone, or two or more thereof may be used in combination. The content of the water-soluble carboxylic acid(s) or the salt(s) is preferably 0.1 g/L to 10 g/L, more preferably 0.5 g/L to 8 g/L, and furthermore preferably 1 g/L to 5 g/L. When the content of the water-soluble carboxylic acid(s) or the salt(s) is within such ranges, $Cr^{3+}$ can be stabilized through the complex formation with the chromium ions.

The chemical conversion treatment solution for a zinc or zinc alloy substrate of the present invention preferably contains the water-soluble zirconium compound and the fluorine-containing compound in the form of fluorozirconic acid.

The chemical conversion treatment solution for a zinc or zinc alloy substrate of the present invention may further contain one or more selected from the group consisting of: i) water-soluble metal salts each containing a metal selected from the group consisting of Al, Ti, Mo, V, Ce and W; ii) Si compounds; and iii) phosphorus compounds.

Examples of the water-soluble metal salts include $K_2TiF_6$, and the like. These water-soluble metal salts may be used alone, or two or more thereof may be used in combination. The content of the water-soluble metal salt(s) is preferably 0.1 g/L to 1.5 g/L, and more preferably 0.2 g/L to 1.0 g/L.

Examples of the Si compounds include $SiO_2$ (colloidal silica), and the like. These Si compounds may be used alone, or two or more thereof may be used in combination. The content of the Si compound(s) is preferably 0.1 g/L to 10 g/L, more preferably 0.5 g/L to 5.0 g/L, and furthermore preferably 1.0 g/L to 3.0 g/L.

Examples of the phosphorus compounds include $NaH_2PO_2$ (sodium hypophosphite), and the like. These phosphorus compounds may be used alone, or two or more thereof may be used in combination. The content of the phosphorus compound(s) is preferably 0.01 g/L to 1.0 g/L, and more preferably 0.1 g/L to 0.5 g/L.

The chemical conversion treatment solution for a zinc or zinc alloy substrate of the present invention has a pH preferably within a range of 1 to 6, and more preferably within a range of 1.5 to 4.

The balance of the chemical conversion treatment solution for a zinc or zinc alloy substrate of the present invention other than the above-described components is water.

In a method for forming a trivalent chromium chemical conversion coating on the zinc or zinc alloy plating by using the chemical conversion treatment solution for a zinc or zinc alloy substrate of the present invention, a substrate plated with zinc or a zinc alloy is generally immersed in the chemical conversion treatment solution. In the event of the immersion, the temperature of the chemical conversion treatment solution is preferably 20 to 60° C., and more preferably 30 to 40° C. The immersion time is preferably 5 to 600 seconds, and more preferably 30 to 300 seconds. Note that, to activate the zinc- or zinc alloy-plated surface, the substrate may be immersed in a diluted nitric acid solution (such as 5% nitric acid), a diluted sulfuric acid solution, a diluted hydrochloric acid solution, a diluted hydrofluoric acid solution, or the like before the trivalent chromium chemical conversion treatment. Conditions and treatment operations other than those described above may follow conventional methods for hexavalent chromate conversion treatment.

The trivalent chromium chemical conversion coating thus formed on the zinc or zinc alloy plating by using the chemical conversion treatment solution for a zinc or zinc alloy substrate of the present invention contains trivalent chromium and zirconium, but does not contain hexavalent chromium and cobalt. In the trivalent chromium chemical conversion coating, the proportion of zirconium (Zr/(Cr+Zr)) is preferably 60 to 90% by weight.

Next, the present invention will be described based on Examples and Comparative Examples. However, the present invention is not limited to Examples.

EXAMPLES

As test pieces, 0.5 mm×50 mm×70 mm SPCC steel plates were used, and the surfaces were subjected to zincate/zinc plating. The zinc platings had film thicknesses of 9 to 10 micrometers.

The zinc plated test pieces were immersed in an aqueous solution of 5% nitric acid at normal temperature for 10 seconds, and then the test pieces were sufficiently rinsed with running tap water to clean the surfaces. Additionally, alkaline immersion, washing with hot water, or the like may be conducted depending on the surface states of the test pieces.

The methods for conducting a chemical conversion treatment are described in Examples and Comparative Examples below.

After the chemical conversion treatment, the test pieces were sufficiently washed with tap water and ion-exchanged water, then left standing for 10 minutes in an electric drying furnace kept at 80° C., and dried.

The chemical conversion coatings were evaluated for the appearances in terms of color tone and uniformity.

Favorable=appearance with even color tone of pale blue to pale yellow, and with glossiness and uniformity Fair=appearance with somewhat uneven color tone of pale blue to pale yellow, and with less uniformity Poor=appearance with color tone outside the range of pale blue to pale yellow, and/or with no uniformity and less glossiness.

After the chemical conversion treatment, the test pieces were subjected to a salt spray test (hereinafter SST) in accordance with JIS Z-2371, and evaluated for the corrosion resistances according to the area of white rust formed after 72 hours, 120 hours, and 240 hours. The test results were categorized into four groups and evaluated: ○=no white rust was formed; Δ=white rust accounted for less than 5%; ▲=white rust accounted for 5% or more; and x=red rust was formed.

1. Metal Concentration Evaluation

Example 1

As shown below, a chemical conversion treatment solution was prepared, and a caustic soda solution was used to make the pH=2.0. Then, the above-described test pieces were subjected to the immersion treatment at 30° C. for 40 seconds.

(A) 40% Chromium nitrate: 12 g/L (Cr was 20 mmol/L)
(B) Fluorozirconic acid: 5.2 g/L (Zr was 10 mmol/L)
(C) Oxalic acid: 1.4 g/L (15 mmol/L)
Malonic acid: 1.6 g/L (15 mmol/L)
The balance is water.

Example 2

As shown below, a chemical conversion treatment solution was prepared, and a caustic soda solution was used to make the pH=2.0. Then, the above-described test pieces were subjected to the immersion treatment at 30° C. for 40 seconds.

(A) 40% Chromium nitrate: 12 g/L (Cr was 20 mmol/L)
(B) Fluorozirconic acid: 10.4 g/L (Zr was 20 mmol/L)
(C) Oxalic acid: 1.4 g/L (15 mmol/L)
Malonic acid: 1.6 g/L (15 mmol/L)
The balance is water.

Example 3

As shown below, a chemical conversion treatment solution was prepared, and a caustic soda solution was used to make the pH=2.0. Then, the above-described test pieces were subjected to the immersion treatment at 30° C. for 40 seconds.

(A) 40% Chromium nitrate: 12 g/L (Cr was 20 mmol/L)
(B) Fluorozirconic acid: 15.6 g/L (Zr was 30 mmol/L)
(C) Oxalic acid: 1.4 g/L (15 mmol/L)
Malonic acid: 1.6 g/L (15 mmol/L)
The balance is water.

Example 4

As shown below, a chemical conversion treatment solution was prepared, and a caustic soda solution was used to make the pH=2.0. Then, the above-described test pieces were subjected to the immersion treatment at 30° C. for 40 seconds.

(A) 40% Chromium nitrate: 12 g/L (Cr was 20 mmol/L)
(B) Fluorozirconic acid: 26 g/L (Zr was 50 mmol/L)
(C) Oxalic acid: 1.4 g/L (15 mmol/L)
Malonic acid: 1.6 g/L (15 mmol/L)
The balance is water.

Example 5

As shown below, a chemical conversion treatment solution was prepared, and 62% nitric acid was used to make the pH=4.0.

Then, the above-described test pieces were subjected to the immersion treatment at 30° C. for 40 seconds.

(A) 40% Chromium nitrate: 3 g/L (Cr was 5 mmol/L)
(B) Fluorozirconic acid: 5.2 g/L (Zr was 10 mmol/L)
The balance is water.

Example 6

As shown below, a chemical conversion treatment solution was prepared, and 62% nitric acid was used to make the pH=2.0. Then, the above-described test pieces were subjected to the immersion treatment at 30° C. for 40 seconds.
(A) 40% Chromium nitrate: 12 g/L (Cr was 20 mmol/L)
(B) Ammonium zirconium carbonate solution ($ZrO_2$ 20%: 6.2 g/L (Zr was 10 mmol/L)
(C) 50% Lactic acid: 3.6 g/L (lactic acid was 20 mmol/L)
The balance is water.

Comparative Example 1

As shown below, a chemical conversion treatment solution was prepared, and a caustic soda solution was used to make the pH=2.0. Then, the above-described test pieces were subjected to the immersion treatment at 30° C. for 40 seconds.
(A) 40% Chromium nitrate: 48 g/L (Cr was 80 mmol/L)
(B) Cobalt nitrate: Co was 1.0 g/L
(C) Oxalic acid: 1.4 g/L (15 mmol/L)
Malonic acid: 1.6 g/L (15 mmol/L)
The balance is water.

Comparative Example 2

As shown below, a chemical conversion treatment solution was prepared, and a caustic soda solution was used to make the pH=2.0. Then, the above-described test pieces were subjected to the immersion treatment at 30° C. for 40 seconds.
(A) 40% Chromium nitrate: 24 g/L (Cr was 40 mmol/L)
(B) Cobalt nitrate: Co was 1.0 g/L
(C) Oxalic acid: 1.4 g/L (15 mmol/L)
Malonic acid: 1.6 g/L (15 mmol/L)
The balance is water.

Table 1 summarizes the composition of each treatment solution in Examples 1 to 6 and Comparative Examples 1 and 2. Table 2 shows the evaluation results. Table 3 shows the trivalent chromium and zirconium contents in the coating.

TABLE 1

Treatment solution composition

| | Treatment solution composition (mmol/L) | | | | $Cr^{3+}/Zr^{4+}$ | Dicarboxylic |
|---|---|---|---|---|---|---|
| | $Cr^{3+}$ | $Zr^{4+}$ | $F^-$ | $Co^{2+}$ | molar ratio | acid (g/L) |
| Example 1 | 20 | 10 | 60 | — | 2.0 | oxalic acid 1.4 + |
| Example 2 | 20 | 20 | 120 | — | 1.0 | malonic acid 1. 6 |
| Example 3 | 20 | 30 | 180 | — | 0.6 | |
| Example 4 | 20 | 50 | 300 | — | 0.4 | |
| Example 5 | 5 | 10 | 60 | — | 0.5 | — |
| Example 6 | 20 | 10 | — | — | 2.0 | |
| Comparative Example 1 | 80 | — | — | 20 | — | oxalic acid 1.4 + malonic acid 1.6 |
| Comparative Example 2 | 40 | — | — | 20 | — | |

TABLE 2

Corrosion resistance evaluation result

| | | General corrosion resistance | | |
|---|---|---|---|---|
| | Appearance | 72 h | 120 h | 240 h |
| Example 1 | favorable | ○ | ○ | ○ |
| Example 2 | favorable | ○ | ○ | ○ |
| Example 3 | favorable | ○ | ○ | ○ |
| Example 4 | favorable | ○ | ○ | ○ |
| Example 5 | favorable | ○ | Δ | Δ |
| Example 6 | favorable | ○ | Δ | Δ |
| Comparative Example 1 | favorable | ○ | ○ | ○ |
| Comparative Example 2 | favorable | ○ | ○ | Δ |

TABLE 3

Trivalent chromium and zirconium contents in the coating

| | Cr ($mg/dm^2$) | Zr ($mg/dm^2$) | Zr/(Cr + Zr) |
|---|---|---|---|
| Example 1 | 0.33 | 0.54 | 0.62 |
| Example 2 | 0.34 | 0.66 | 0.66 |
| Example 3 | 0.34 | 0.73 | 0.68 |
| Example 4 | 0.34 | 0.88 | 0.72 |
| Example 5 | 0.34 | 0.88 | 0.72 |
| Example 6 | 0.34 | 0.88 | 0.72 |

From the result in Table 2, Examples 1 to 6 successfully formed coatings having performances equivalent to those in Comparative Examples 1 and 2 containing cobalt.

2. Dicarboxylic Acid Evaluation

Example 7

As shown below, a chemical conversion treatment solution was prepared, and an aqueous solution of caustic soda was used to make the pH=2.0. Then, the above-described test pieces were subjected to the immersion treatment at 30° C. for 40 seconds.
(A) 40% Chromium nitrate: 12 g/L (Cr was 20 mmol/L)
(B) Fluorozirconic acid: 10.4 g/L (Zr was 20 mmol/L)
(C) Oxalic acid: 1.8 g/L (20 mmol/L)
The balance is water.

Example 8

As shown below, a chemical conversion treatment solution was prepared, and an aqueous solution of caustic soda was used to make the pH=2.0. Then, the above-described test pieces were subjected to the immersion treatment at 30° C. for 40 seconds.
(A) 40% Chromium nitrate: 12 g/L (Cr was 20 mmol/L)
(B) Fluorozirconic acid: 10.4 g/L (Zr was 20 mmol/L)
(C) Malonic acid: 2.0 g/L (20 mmol/L)
The balance is water.

Example 9

As shown below, a chemical conversion treatment solution was prepared, and an aqueous solution of caustic soda was used to make the pH=2.0. Then, the above-described test pieces were subjected to the immersion treatment at 30° C. for 40 seconds.

(A) 40% Chromium nitrate: 12 g/L (Cr was 20 mmol/L)
(B) Fluorozirconic acid: 10.4 g/L (Zr was 20 mmol/L)
(C) Succinic acid: 2.4 g/L (20 mmol/L)
The balance is water.

Example 10

As shown below, a chemical conversion treatment solution was prepared, and an aqueous solution of caustic soda was used to make the pH=2.0. Then, the above-described test pieces were subjected to the immersion treatment at 30° C. for 40 seconds.
(A) 40% Chromium nitrate: 12 g/L (Cr was 20 mmol/L)
(B) Fluorozirconic acid: 10.4 g/L (Zr was 20 mmol/L)
(C) Glutaric acid: 2.7 g/L (20 mmol/L)
The balance is water.

Example 11

As shown below, a chemical conversion treatment solution was prepared, and an aqueous solution of caustic soda was used to make the pH=2.0. Then, the above-described test pieces were subjected to the immersion treatment at 30° C. for 40 seconds.
(A) 40% Chromium nitrate: 12 g/L (Cr was 20 mmol/L)
(B) Fluorozirconic acid: 10.4 g/L (Zr was 20 mmol/L)
(C) Adipic acid: 3.0 g/L (20 mmol/L)
The balance is water.

Example 12

As shown below, a chemical conversion treatment solution was prepared, and an aqueous solution of caustic soda was used to make the pH=2.0. Then, the above-described test pieces were subjected to the immersion treatment at 30° C. for 40 seconds.
(A) 40% Chromium nitrate: 12 g/L (Cr was 20 mmol/L)
(B) Fluorozirconic acid: 10.4 g/L (Zr was 20 mmol/L)
(C) Suberic acid: 3.5 g/L (20 mmol/L)
The balance is water.

Table 4 summarizes the composition of each treatment solution in Examples 7 to 12. Table 5 shows the evaluation results.

TABLE 4

| Treatment solution composition | | | | | | |
|---|---|---|---|---|---|---|
| | Treatment solution composition (mmol/L) | | | | $Cr^{3+}/Zr^{4+}$ | Dicarboxylic acid |
| | $Cr^{3+}$ | $Zr^{4+}$ | $F^-$ | $Co^{2+}$ | molar ratio | (20 mmoL/L) |
| Example 7 | 20 | 20 | 120 | — | 1.0 | oxalic acid |
| Example 8 | 20 | 20 | 120 | — | 1.0 | malonic acid |
| Example 9 | 20 | 20 | 120 | — | 1.0 | succinic acid |
| Example 10 | 20 | 20 | 120 | — | 1.0 | glutaric acid |
| Example 11 | 20 | 20 | 120 | — | 1.0 | adipic acid |
| Example 12 | 20 | 20 | 120 | — | 1.0 | suberic acid |

TABLE 5

| Corrosion resistance evaluation result | | | | |
|---|---|---|---|---|
| | | General corrosion resistance | | |
| | Appearance | 72 h | 120 h | 240 h |
| Example 7 | favorable | ○ | ○ | ○ |
| Example 8 | favorable | ○ | ○ | ○ |

TABLE 5-continued

| Corrosion resistance evaluation result | | | | |
|---|---|---|---|---|
| | | General corrosion resistance | | |
| | Appearance | 72 h | 120 h | 240 h |
| Example 9 | favorable | ○ | Δ | Δ |
| Example 10 | favorable | ○ | Δ | Δ |
| Example 11 | favorable | ○ | Δ | Δ |
| Example 12 | favorable | ○ | Δ | ▲ |

From the above, it was demonstrated that when oxalic acid $C_0$—$(COOH)_2$ and malonic acid $C_1$—$(COOH)_2$ were used, the corrosion resistances were particularly favorable.

The invention claimed is:

1. A chemical conversion treatment solution for a zinc or zinc alloy substrate, the solution comprising:
2 to 200 mmol/L of trivalent chromium ions;
1 to 300 mmol/L of zirconium ions;
fluorine ions; and
1 to 5 g/L oxalic acid or salts thereof or 1 to 5 g/L of a combination of oxalic acid or salts thereof and malonic acid or salts thereof;
wherein the solution does not comprise Co ions and hexavalent chromium ions.

2. The chemical conversion treatment solution according to claim 1, wherein a molar ratio of the trivalent chromium ions to the zirconium ions (trivalent chromium ions/zirconium ions) is 2.5 or less.

3. The chemical conversion treatment solution according to claim 1, wherein a zirconium compound for providing the zirconium ions is an inorganic zirconium compound or a salt thereof, or an organic zirconium compound.

4. The chemical conversion treatment solution according to claim 1, wherein the zirconium compound for providing the zirconium ions is zirconium hydrofluoric acid or a salt thereof.

5. The chemical conversion treatment solution according to claim 1, further comprising one or more selected from the group consisting of:
i) water-soluble metal salts each containing a metal selected from the group consisting of Al, Ti, Mo, V, Ce and W;
ii) Si compounds; and
iii) phosphorus compounds.

6. A method for chemical conversion treating a zinc or zinc alloy substrate, the method comprising bringing the chemical conversion treatment solution according to claim 1 into contact with a zinc or zinc alloy substrate.

7. A chemical conversion treatment coating formed from the chemical conversion treatment solution according to claim 1, the coating comprising trivalent chromium and zirconium but not comprising hexavalent chromium and cobalt.

8. The chemical conversion treatment solution according to claim 1, wherein the solution comprises 5 to 500 mmol/L of fluorine ions.

9. The chemical conversion treatment solution according to claim 5, wherein the solution comprises 0.1 to 1.5 g/L of water-soluble metal salts.

10. The chemical conversion treatment solution according to claim 5, wherein the solution comprises 0.1 to 10 g/L of Si compounds.

11. The chemical conversion treatment solution according to claim 5, wherein the solution comprises 0.01 to 1.0 g/L of phosphorus compounds.

12. The chemical conversion treatment coating according to claim 7, wherein a proportion of zirconium is 60 to 90% by weight of a combined weight of zirconium and chromium.

* * * * *